US005499779A

United States Patent [19]

Raudaskoski

[11] Patent Number: 5,499,779

[45] Date of Patent: Mar. 19, 1996

[54] METHOD FOR DRUM WINDING A WEB AND A DRUM WINDER

[75] Inventor: Vesa Raudaskoski, Järvenpää , Finland

[73] Assignee: Valmet Paper Machinery Inc., Helsinki, Finland

[21] Appl. No.: 261,340

[22] Filed: Jun. 16, 1994

[30] Foreign Application Priority Data

Jun. 30, 1993 [FI] Finland ..... 933010

[51] Int. Cl.[6] ..... B65H 18/20

[52] U.S. Cl. ..... 242/541.4; 242/542

[58] Field of Search ..... 242/541.4, 542, 242/542.2, 542.3

[56] References Cited

U.S. PATENT DOCUMENTS 3,346,209 10/1967 Cronin .
3,497,151 2/1970 Voss et al. .
3,515,183 6/1970 Voss ..... 242/542
3,858,820 1/1975 Crouse ..... 242/542

FOREIGN PATENT DOCUMENTS 1047001 12/1958 Germany .
1111496 7/1961 Germany .
3618955 12/1987 Germany .

*Primary Examiner*—John P. Darling
*Attorney, Agent, or Firm*—Steinberg, Raskin & Davidson

[57] ABSTRACT

A method for drum winding a web and a drum winder in which a roll that is being formed, i.e., onto which a web is being wound, is supported on winding drums. At least a part of the area that surrounds the roll being formed is subjected to a pressure lower than the pressure that prevails in a gap formed by the roll being formed and the winding drums, whereby a floating effect is produced on the roll being formed. The drum winder is preferably placed in a vacuum chamber.

19 Claims, 3 Drawing Sheets

METHOD FOR DRUM WINDING A WEB AND A DRUM WINDER

BACKGROUND OF THE INVENTION

The present invention relates to a method for drum winding a web, wherein the roll that is being formed, i.e., the roll onto which the web is being wound, is supported on winding drums.

The present invention also relates to a drum winder, comprising winding drums that support the roll that is being formed and a rider roll that presses the roll being formed.

In drum winding, it is desirable to lower the linear nip loads produced by the weight of the growing roll, because otherwise the linear loads that act in the nips will become excessively high, causing defects in the roll.

With respect to the prior art, reference is made to the publications DE 1,047,001, DE 1,111,496, DE 3,618,955, and U.S. Pat. No. 3,497,151. In the devices described in these prior art references, it is known to apply pressure into the gap formed by the roll that is being formed and by the winding drums, whereby a relief effect is applied to the roll that is formed. As a result of this effect, the linear loads in the nips cannot become excessively high. In order that the pressure should be retained in the gap formed by the roll and by the winding drums, it is known from the prior art to seal the gap from above and from below, respectively, by means of various sealing constructions. From the publication DE 1,047,001, it is known to move the upper roll-end sealing unit in an axial direction of the roll.

In addition, from U.S. Pat. No. 3,346,209, it is known to regulate the pressure present in the gap formed by the roll and the winding drums by moving the lower drum in a substantially vertical direction, i.e., up and down.

Even though by means of the prior art devices described above, considerable improvement in the winding of a web onto a roll is achieved, they involve certain drawbacks. For example, sealing of the gap formed by the roll that is formed and the winding drums is generally problematic. The pressure always leaks to some extent, which results in problems of dust formation. Owing to the leakage of the pressure, a very large quantity of air is needed to maintain the pressure, which air spreads into the working environment, for which reason the dust is readily separated from the web that is wound and spreads into the working environment.

Moreover, the prior art devices restrict or at least hamper some operations that are necessary in the roll formation. One of these operations is the roll change wherein when the roll that is being wound becomes complete, a new roll spool must be fed into the gap between the winding drums, the web that is wound must be cut off, and the end of the cut-off web must be attached to the new roll spool. Thus, during roll change operations, various actuators are needed, such as web holders, cutting means, devices for the feed of a new roll spool, etc.

OBJECTS AND SUMMARY OF THE INVENTION

Accordingly, it is an object of the present invention to provide an improvement over the prior art methods of drum winding and drum winders.

It is another object of the present invention to provide a drum winder, and method for drum winding a web, that have the same advantages as so-called pressure winders but in which the numerous drawbacks involved in the prior art devices are avoided.

The objects of the invention stated above, and others, are achieved in the method of the invention, by subjecting at least a part of the area that surrounds the roll that is being formed, i.e., onto which the web is being wound, to a pressure lower than the pressure that prevails in the gap formed by the roll being formed and the winding drums, whereby a floating effect is produced on the roll being formed.

The magnitude of the floating effect or floating force depends on the location of the area of reduced pressure that surrounds the roll that is being formed. In the embodiments of the invention, the sum, i.e., the resultant of the forces applied to the roll being formed and arising from the different pressures surrounding the roll being formed lowers the linear load between the roll being formed and the winding drum.

The objects of the present invention are achieved in the drum winder in accordance with the invention, by providing means to subject at least a part of the area that surrounds the roll that is being formed to a pressure lower than the pressure prevailing in the gap formed by the roll being formed and by the winding drums.

Thus, in the drum winder in accordance with the invention, a negative pressure is produced in at least a part of the area surrounding the roll whereas the gap formed by the roll and the winding drums is at a higher pressure, generally at a normal atmospheric pressure. In such a case, a floating effect is applied to the roll that is being formed which is similar to the effect produced when a pressure is applied to the gap.

By means of the present invention, a number of remarkable advantages are achieved over the prior art devices. The device and method in accordance with the invention permit a constantly optimal control of the winding, because the difference in pressure $\Delta p$ between the gap and the environment subjected to negative pressure can be adjusted to the desired level continuously. Thus, the device and method in accordance with the invention permit an increase in the roll diameter to a larger size without harmful roll defects caused by the weight of the roll applied against the winding drums and resulting in high linear nip loads. In addition, the present invention does not significantly hamper the operation of the roll change means. By means of the present invention, the dust problems can be almost completely eliminated. Moreover, the invention attenuates the noise arising from the winding.

The invention will be described in detail with reference to some preferred embodiments of the invention illustrated in the figures in the drawing. The invention is, however, not confined to these embodiments alone.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
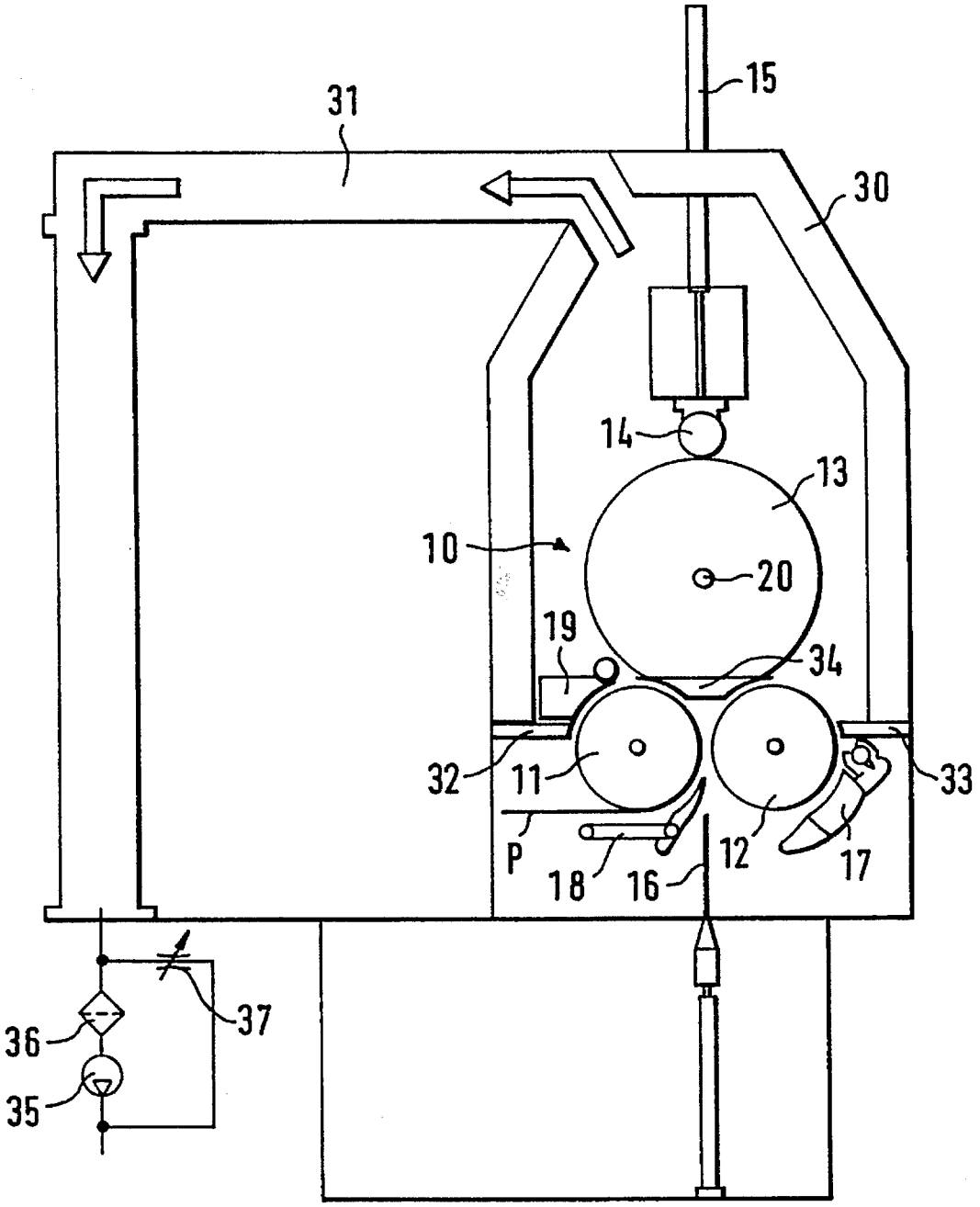
FIG. 1 shows a preferred embodiment of a drum winder in accordance with the invention, and used in the method in accordance with the invention, as viewed from the end.

Referring to the drawings, wherein the same reference numerals refer to the same elements, in FIG. 1, a drum winder in accordance with the invention and used in the method in accordance with the invention, is denoted generally by reference numeral 10. A pair of winding drums are denoted by reference numerals 11 and 12, the roll that is being formed, i.e., onto which a web is being wound, is denoted by reference numeral 13, and a rider roll is denoted by reference numeral 14. The rider roll 14 presses the web on the roll being formed. The cylinder of the rider roll 14 is denoted by reference numeral 15. The cutter device for a web P in the drum winder 10 is denoted by reference numeral 16, the spool feed device is denoted by reference numeral 17, and the web threading device is denoted by reference numeral 18. A full and complete roll 13 is removed by means of a suitable remover device. In the embodiment as shown in FIG. 1, a roll ejector 19 is used. Reference numeral 20 represents the spool lock of the roll spool. The drum winder 10 described above is a typical and conventional prior art drum winder.

Figure 2:
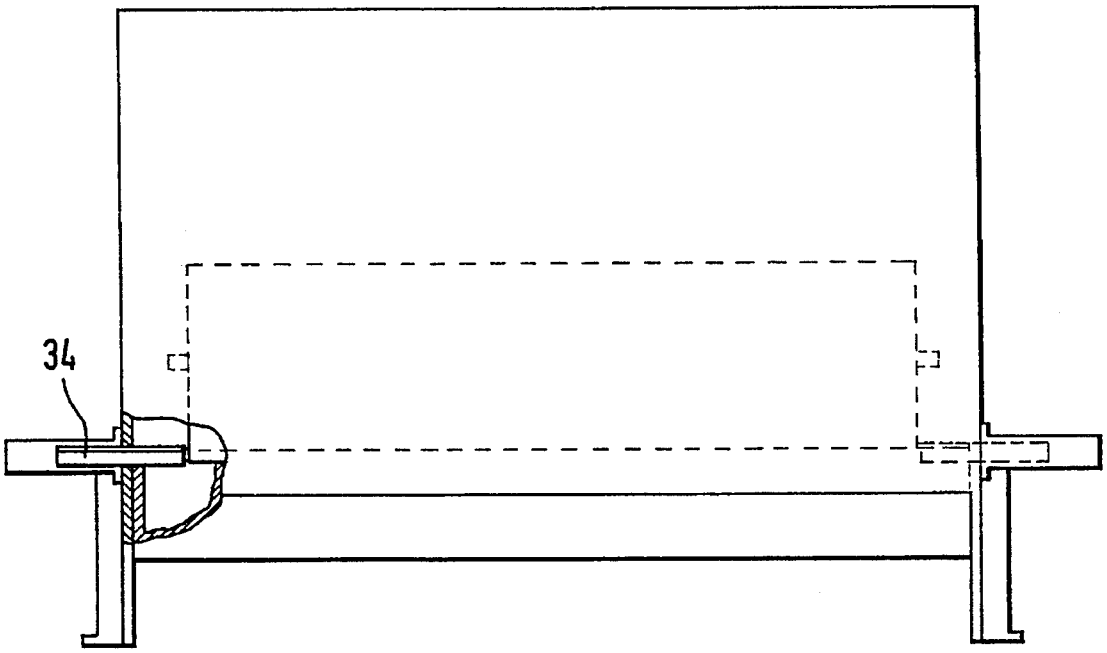
FIG. 2 is a front view of the embodiment as shown in FIG. 1.

In accordance with the invention, the winding part of the drum winder 10 is, in the embodiment of FIG. 1, placed in a vacuum chamber 30. The winding part of the drum winder is understood as the unit that comprises the winding drums, the ejectors, the spool locks, and the roll. The drum winder also generally includes a slitter part and an unwind stand (not shown). However, it is understood that the invention can also be applied so that the slitter part and the unwind stand are placed in a large vacuum chamber. Negative pressure is produced in the vacuum chamber 30 by means of a system of suction pipes 31. Seal units are arranged between the vacuum chamber 30 and each of the winding drums 11,12 and are denoted by reference numerals 32,33, respectively. Separate seal units 32 and 33 are not necessarily needed and the seal part for sealing the space between the chamber 30 and the drums 11,12 can be integrated, e.g., in the walls of the vacuum chamber 30. The vacuum chamber 30 must also be sealed at the end of the roll 13. As shown in FIG. 2, the end seal unit of the roll is denoted by reference numeral 34.

As shown in FIG. 1, a vacuum pump/blower/exhauster unit 35 produces a negative pressure in the system of suction pipes 31. A filter 36 is arranged between the vacuum pump/blower/exhauster unit 35 and suction pipes 31. Regulating means, such as a vacuum regulator 37, adjust the level of the negative pressure in the vacuum chamber 30 to a desired level. In an alternative embodiment, in order to produce the negative pressure, a system of suction pipes 31 is not needed, and the exhauster unit 35 can be placed inside the vacuum chamber 30.

Figure 3:
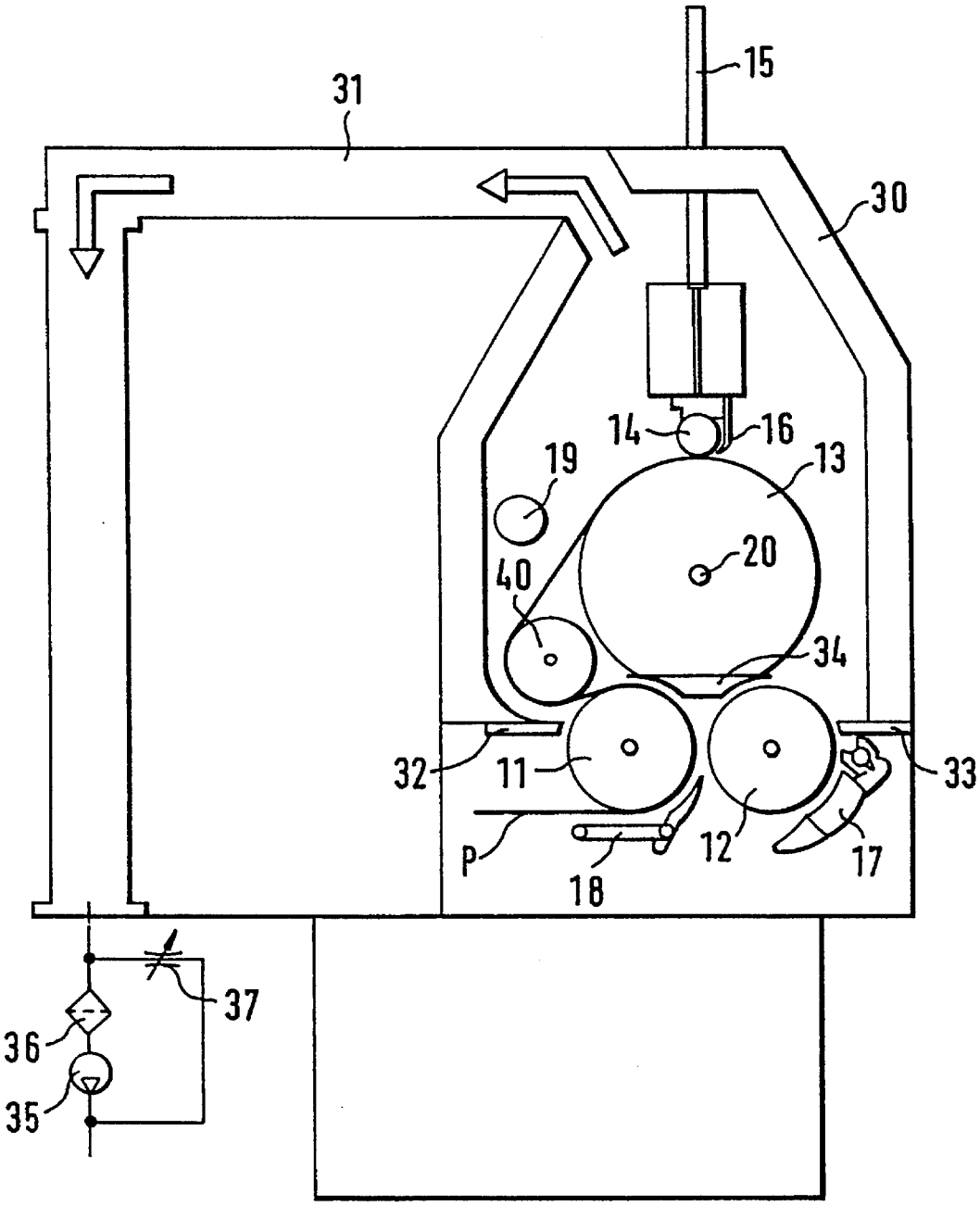
FIG. 3 shows a second preferred embodiment of a drum winder in accordance with the invention, and used in the method in accordance with the invention, as viewed from the end.

The embodiment shown in FIG. 3 is similar to that shown in FIGS. 1 and 2 and the same reference numerals elements refer to the same elements. In the embodiment of FIG. 3, the web P is passed over a reversing roll 40. It should be noted that, when the web P is being wound onto roll 13 in the device as shown in FIGS. 1 and 2, bags, i.e., air bags or pockets, may be formed in the surface layer of the roll 13, especially in the case of web materials that are air-permeable. The bag formations produce roll defects because the air of normal pressure, i.e., of higher pressure, which is present in the gap formed by the winding drums 11 and 12, is placed below the surface layer of the roll 13 that is being formed and induces detrimental bag formation when it has access through the nip formed by the roll 13 and the winding drum and thus is present underneath the inlet layer. In the embodiment of FIG. 3, this adverse phenomenon has been eliminated by means of the reversing roll 40 which causes the web to pass through the nip formed between the drum 11 and the roll 13, separate from the drum 11, run over the reversing roll 40 and then wind onto the roll 13.

In the embodiments shown in FIGS. 1–3, the web P is shown as being passed between the winding drums 11 and 12. It is obvious though that the web P can also be passed equally well either from above or from the front as is used in prior art devices. The mode of introduction of the web P only affects the location of the reversing roll 40.

In the embodiments shown in FIGS. 1–3, the entire winding part in the drum winder is surrounded by the vacuum chamber 30. This is not necessary, but it is sufficient that at least a part of the area that surrounds the roll 13 outside of the gap is subjected to negative pressure. This part is preferably situated in an upper region of the roll, i.e., the top half, so that the negative pressure (suction) draws the roll upward relieving the linear loads in the nips formed between the roll 13 and the drums 11,12. Thus, it is seen that the extent of the floating effect or floating force depends on the location of the area of reduced pressure that surrounds the roll.

In the embodiments shown in FIGS. 1–3, the sum, i.e., the resultant of the forces applied to the roll 13 that is being formed and arising from the different pressures surrounding the roll 13 that is being formed lowers the linear load between the roll 13 being formed and the winding drum. In the embodiments shown in FIGS. 1–3, the magnitude of the floating force Fk depends on the areas of effect of the different pressures and on the levels of the pressures in accordance with the following formula:

$$F_k = A_1 p_1 - A_2 p_2;$$

wherein A1 is the area to which the lower pressure is applied, $p_1$ is the level of the lower pressure, $A_2$ is the area to which the higher pressure is applied, and $p_2$ is the level of the higher pressure.

It is not necessary to use an end-seal unit 34 unless a chamber 30 is used that surrounds the entire roll 13, in which case the space between the roll 13 and the chamber 30 must be sealed by means of some seal unit at the cylinder face of the roll 13.

As described above, it is important feature of the invention that at least a part of the area that surrounds the roll outside of the gap is subjected to a pressure lower than the pressure prevailing in the gap. However, it is understood that an upward pressure can also be applied in the gap so long as the pressure to which the part of the area of the roll outside of the gap is subjected is lower than the pressure prevailing in the gap in order to produce the floating effect on the roll.

The examples provided above are not meant to be exclusive. Many other variations of the present invention would be obvious to those skilled in the art, and are contemplated to be within the scope of the appended claims.

I claim:

1. Method for drum winding a web onto a roll supported on winding drums, wherein the web is wound over one of the winding drums onto the roll and a first pressure exists in a gap formed between the roll and winding drums, said first pressure being atmospheric pressure, comprising the step of:

subjecting at least a part of the area that surrounds the roll outside of the gap to a second pressure lower than the first pressure to produce a floating effect on the roll, said second pressure being a negative pressure.

2. The method of claim 1, further comprising the step of adjusting the location of the area surrounding the roll and subjected to the second pressure to influence the magnitude of the floating effect.

3. The method of claim 1, further comprising the steps of arranging at least the winding drums and roll in a vacuum chamber, and applying negative pressure corresponding to the second pressure in the vacuum chamber.

4. The method of claim 3, further comprising the steps of coupling suction pipes to the vacuum chamber and applying negative pressure through the suction pipes.

5. The method of claim 4, further comprising the step of regulating the magnitude of the negative pressure applied to the vacuum chamber through the suction pipes.

6. The method of claim 3, further comprising the step of sealing the vacuum chamber by sealing spaces between the vacuum chamber and the winding drums.

7. The method of claim 3, further comprising the step of sealing the vacuum chamber at ends of the roll.

8. The method of claim 1, further comprising the step of regulating the magnitude of the second pressure to which at least a part of the area that surrounds the roll is subjected.

9. The method of claim 1, further comprising the step of winding the web over a reversing roll before the web is wound onto the roll and after the web is wound over said one of said winding drums.

10. The method of claim 1, wherein the part of the area that surrounds the roll which is subjected to the second pressure is situated in an upper region of the roll.

11. The method of claim 1, further comprising the step of adjusting the size of the area surrounding the roll and subjected to the second pressure to influence the magnitude of the floating effect.

12. Drum winder for winding a web onto a roll supported on winding drums, wherein the web is wound over one of the winding drums onto the roll, and a first pressure exists in a gap formed between the roll and winding drums, said first pressure being atmospheric pressure, comprising means for applying a second pressure lower than the first pressure to at least a part of the area that surrounds the roll outside of said gap, said second pressure being a negative pressure.

13. The drum winder of claim 12, further comprising a vacuum chamber in which said second pressure is applied, said winding drums and said roll being situated in said vacuum chamber.

14. The drum winder of claim 13, wherein said means comprise a system of suction pipes coupled to said vacuum chamber and through which said second pressure is applied in said vacuum chamber.

15. The drum winder of claim 13, further comprising sealing means for sealing said vacuum chamber, said seal means being arranged in spaces between said vacuum chamber and said winding drums and at ends of said roll.

16. The drum winder of claim 12, further comprising regulating means for regulate the magnitude of said second pressure.

17. The drum winder of claim 12, further comprising a reversing roll over which the web is wound before the web is wound onto said roll and after the web is wound over said one of said winding drums.

18. The drum winder of claim 12, further comprising a rider roll for pressing the web on the roll.

19. Drum winder for winding a web onto a roll supported on winding drums, wherein the web is wound over one of the winding drums onto the roll, and a first pressure exists in a gap formed between the roll and winding drums, comprising means for applying a second pressure lower than the first pressure to at least a part of the area that surrounds the roll outside of said gap, and regulating means for regulate the magnitude of said second pressure.

* * * * *